US006210020B1

(12) United States Patent
Van Dulmen et al.

(10) Patent No.: US 6,210,020 B1
(45) Date of Patent: Apr. 3, 2001

(54) CAPPED ELECTRIC LAMP

(75) Inventors: Hendrikus A. M. Van Dulmen, Eindhoven; Ralph H. Peters, Maastricht; Wilhelmus J. M. Manders, Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/277,655

(22) Filed: Mar. 26, 1999

(30) Foreign Application Priority Data

Apr. 6, 1998 (EP) ..... 98201058
Oct. 7, 1998 (EP) ..... 98203381

(51) Int. Cl.[7] ..... H01J 5/50

(52) U.S. Cl. ..... 362/226; 362/263; 313/318.01; 313/318.11

(58) Field of Search ..... 362/226, 306, 362/390, 267, 263, 296; 313/318.11, 318.01, 318.05

(56) References Cited

U.S. PATENT DOCUMENTS 4,595,859 6/1986 Steiner et al. .
5,239,226 * 8/1993 Seredich et al. ..... 362/226
5,479,066 12/1995 Willems et al. .
5,839,818 * 11/1998 Janson et al. ..... 362/226
5,855,430 * 1/1999 Coushaine et al. ..... 362/226

FOREIGN PATENT DOCUMENTS 1034268 12/1958 (DE) .

* cited by examiner

*Primary Examiner*—Thomas M. Sember
(74) *Attorney, Agent, or Firm*—Dicran Halajian

(57) ABSTRACT

An electric lamp comprises a lamp vessel (1) and a cap (10) having integrally a housing (11) and an intermediate spring part (15) with a connecting device (17) on it. The cap is supplied with contact members (14) and reference studs. The spring part keeps the lamp positioned on a carrier (30) by a permanent press force. The electric lamp is compact, can be simply assembled and can be used in front-, back- and plate-mounting, possibly in combination with an adapter (25).

19 Claims, 3 Drawing Sheets

CAPPED ELECTRIC LAMP

BACKGROUND OF THE INVENTION

This invention relates to a capped electric lamp provided with:

a translucent lamp vessel which is closed in a gastight manner, which has an axis, and in which an electric element is arranged, said element having a center and being connected to current conductors which issue from the lamp vessel to the exterior;

a lamp cap connected to the lamp vessel and comprising a housing;

which housing is provided with:

contact members connected to the current conductors, at least one reference means, at least one locking means for locking the connection of the lamp vessel to the lamp cap, and at least one coupling means.

Such a capped electric lamp is known from EP-A-0 618 609 to which U.S. Pat. 5,479,066 corresponds. The known lamp is provided with a pressure body to which the lamp vessel is coupled. The pressure body is coupled to the housing by means of a snap connection, the housing having a circumferential wall which runs parallel to the axis. A separate elastic body, for example, a rubber disc or ring, is arranged between the in pressure body and the housing, as seen in axial direction. The elasticity of the disc or ring causes a permanent force to be present between the housing and the pressure body, so that the pressure body with the lamp vessel coupled thereto remains correctly positioned with respect to the housing. A number of functions of the lamp cap, such as contact members, reference and coupling means, are present in positions which are axially shifted relative to one another. As a result, the lamp has a comparatively large constructional dimension in the axial direction.

The known lamp is suitable for being mounted in a reflector. The lamp has a projecting collar which is provided with studs which cooperate with the reflector and by means of which the lamp cap and the reflector can be coupled to one another in a rotary movement. The known lamp is very suitable for use as a vehicle headlamp.

It is a wish of car manufacturers that the actions to be performed in the assembly of car components, such as, for example, lighting units for vehicles, should be as simple as possible. A further wish is that car components should be universally applicable and uniform, i.e. independent of the assembling method, in the case of lamps, for example, plate, front, and back mounting. The known lamp should accordingly be designed for mounting against a support with the bulb forward (back/plate mounting) or with the lamp cap forward (front mounting), as desired. The lamp will then be retained on the support by additional means, while the electric element occupies a previously defined position with respect to this support.

It is a disadvantage of the known capped lamp that it is not universally applicable owing to the comparatively large and highly asymmetrical lamp cap, for example, it is unsuitable for front mounting. A second disadvantage is the difficulty of assembly of the lamp with the lighting unit, on the one hand owing to the comparatively large number of loose components and on the other hand owing to the comparatively complicated rotary movements necessary for coupling the lamp cap to the reflector. A third disadvantage is that tolerances in the dimensions of the housing and the pressure body are accommodated to a limited degree only by the eleastic ring. This involves a considerable risk that the housing and the pressure body bear upon one another without a permanent resilient pressure, so that the housing and the pressure body can move relative to one another and the electric element will be no longer correctly aligned with respect to the support.

DE-B-1 034 268 discloses a capped electric lamp whose glass bulb is closed with a plate of insulating material which lies in a plane which is at least substantially perpendicular to the axis. A hollow cylindrical lamp cap is fixed to the side of the plate facing away from the bulb in a manner not described in any detail. The known bulb, however, is only designed for assemblies with back/plate mounting. It is desirable for various applications, however, to have a lamp available which can be placed against a support with the lamp cap forward.

SUMMARY OF THE INVENTION

It is an object of the invention to provide a capped electric lamp of the kind described in the opening paragraph which is of a simple construction which can be readily manufactured and which counteracts the above disadvantages.

According to the invention, this object is achieved in that the coupling means forms part of the housing via an integral, resilient intermediate portion. Since the lamp cap comprises no loose components but is made as one integral whole, it offers the advantage of a simple lamp assembly, while at the same time rendering possible a more compact lamp with a smaller constructional dimension for incorporation. The resilient intermediate portion in the mounted state will be in a non-relaxed state, so that there will be a permanent resilient pressure between the coupling means and the reference means. As a result, the reference means and the coupling means will remain in fixed positions relative to one another in the mounted state. The lamp is universally applicable because the compact lamp cap is comparatively small in comparison with the lamp vessel.

In a favorable embodiment, the resilient action of the intermediate portion is obtained in a simple manner by means of a void which extends over substantially an entire cross-sectional area of the intermediate portion. The remaining portion of the cross-sectional area then forms a bridge. The void in the intermediate portion may be provided in various directions, for example parallel to the axis or at an angle to the axis, or, for example, perpendicular to the axis, whereby the resilient action is obtained in a very effective manner because the displacement in the case of resilience here is at least substantially in axial the direction only.

Variation of the number of voids and the dimension of the voids in the axial direction renders possible a simple adjustment of, on the one hand, the relative displacement possibility of the resilient intermediate portion with respect to the housing and, on the other hand, the value of the resilient force which can be realized. A difference in stiffness of the resilient action can be realized in a simple manner in that not one but, for example, two mutually opposed bridges are maintained which lie in one and the same plane perpendicular to the axial direction. A desired value of the permanent resilient force exerted by the lamp cap and a support, for example, a reflector or an adapter, coupled thereto via the reference means, for example in the form of studs, on one another can thus be readily realized. It was found that a force equal to twice the force of gravity is sufficient for keeping the lamp positioned under usual practical circumstances as regards shock and impact loads.

In a favorable embodiment, the contact members, reference means, and coupling means occupy positions which are mutually rotated about the axis and which lie in a common plane transverse to the axis. The capped lamp according to the invention thus has a smaller constructional dimension in the axial direction than a capped lamp in which the various means are positioned in axial direction next to one another. The housing in which the lamp is to be accommodated can be comparatively flat thanks to the comparatively small dimension in axial direction.

When the capped lamp is used as a vehicle lamp in a lighting unit, the "black gap" problem known to those skilled in the art may arise. The black gap is visible during operation of the lighting unit as a dark ring around the illuminated lamp vessel, which ring is surrounded by the light reflected by the reflector, said light originating from the electric element. The black gap is the result of light losses which occur when light originating from the electric element hits the lamp cap. In an embodiment in which the lamp cap lies at least substantially within a cone with an apex in the center of the electric element and with an apex half angle of at most 25°, the favorable situation is obtained that the guidelines for counteracting the black gap problem in vehicle lighting units are complied with.

The contact members are preferably provided with screening means so as to avoid direct contact between the contact members and the skin during handling of the capped lamp and/or for preventing pollution and/or damage by other causes. A more reliable operation of the contact is obtained thereby, for example in that the risk of chemical attacks on the contact members is reduced, which promotes a fast, simple, and reliable assembly of the lighting unit by car workers.

In a further preferred embodiment, the housing comprises a flat base portion which is at least substantially perpendicular to the axis. This base portion serves as an abutment for the placement of the lamp vessel in the lamp cap. The lamp vessel is closed in a gastight manner by means of a plate of insulating material which lies in a plane which is substantially perpendicular to the axis. In the assembly of the lamp according to the invention, the electric element is mounted in a previously defined position with respect to the plate of insulating material. In the state in which the lamp vessel is connected to the lamp cap, the plate of the lamp vessel bears on the base portion of the lamp cap with a permanent compression force. The electric element thus occupies a previously defined position with respect to reference locations of the lamp cap. This embodiment of the lamp has a comparatively very small axial dimension. The comparatively very small axial dimension means that the housing in which the lamp is to be accommodated can be comparatively very flat.

A particularly favorable embodiment relates to a lamp whose lamp cap is provided with at least one uncoupling means. The uncoupling means is resiliently connected to the housing and together with the housing forms an at least substantially axial cylinder which surrounds the coupling means, the latter being preferably a resilient tag. This has the advantage that the lamp can be easily removed in the mounted state. In the mounted state, the coupling means is in a hooked position. When the uncoupling means is pressed towards the axis sufficiently far for achieving a movement of the coupling means in the direction of the axis, the coupling means will leave the hooked position, the lamp is uncoupled and can be removed.

It is favorable to provide the lamp cap with pressure surfaces, preferably on the resilient intermediate portion, for further facilitating a movement of the lamp into the mounted position.

In a further embodiment, the lamp cap is provided with an adapter. Several features may be provided on the adapter, for example, standard contact points for electrical connection, by which the assembly is further simplified, and/or, for example, a rubber ring. When the capped lamp with the adapter coupled thereto is coupled to a reflector, the adapter and reflector will slide over one another with a narrow fit, with the ring in between, which ring is slightly compressed thereby and closes off the narrow fit in a gastight manner. This counteracts that volatile substances can penetrate the reflector through an opening between the lamp cap and the reflector. The ring is kept in place, for example, in that it is held in a groove.

In an alternative embodiment, the rubber ring is provided on the lamp cap, for example lying in a groove, so that a separate adapter is not necessary for closing off the narrow passage between the reflector and the lamp cap in a gastight manner. The penetration of volatile substances into the reflector through the narrow fit is thus counteracted in a comparatively simple manner. Alternatively, the reflector instead of the lamp cap may be provided with the rubber ring. It is favorable if the lamp cap is constructed at least for the major part, from a synthetic resin material. The resilient intermediate portion and the housing may then be made from the same material. It is possible in that case to give the lamp cap comparatively small dimensions because it itself is electrically insulating, which promotes electrical safety. A wide variety of synthetic materials may be used in the lamp cap, for example, thermoplastic synthetic resins, for example, such synthetic resins filled with powder or with fibers such as glass powder or glass fibers, for example polyether imide, polyether sulphon, polyether sulphide, polyphenylene sulphide, polybutylene teraphthalate, etc., the latter synthetic resin being especially suitable for use as the lamp cap housing.

A further favorable embodiment is one in which the capped lamp is provided with a reflector by which the generated light is concentrated into a beam and can be efficiently utilized. The reflector and the lamp cap, and accordingly the electric element, can be accurately positioned relative to one another through the use of the coupling means and the reference means of the lamp cap which cooperate with the reflector.

The electric element of the electric lamp according to the invention may be, for example, an incandescent body, possibly in an inert gas comprising halogen. Alternatively, however, the element may be a pair of electrodes in an ionizable gas. In general, it will be favorable to position the electric element axially, in particular coaxially with the bulb.

The lamp cap of the electric lamp according to the invention is of a universal construction which is suitable for front, back and/or plate mounting, depending on the support, for example an adapter or plate, on which the lamp is placed. The resilient intermediate portion and/or the housing of the lamp cap may be hollow, which provides a saving of lamp cap material and renders the lamp cap lighter.

The electric lamp according to the invention is highly suitable not only as a headlight but also, for example, for use as a lamp at the rear of a vehicle, for example as a brake light, indicator light, rear light, reversing light, fog rear light, etc.

BRIEF DESCRIPTION OF THE DRAWINGS

An embodiment of the electric lamp according to the invention is diagrammatically shown in the drawing, in which.

DETAILED DESCRIPTION OF THE PREFERRED EMBODIMENTS

Figure 1A:
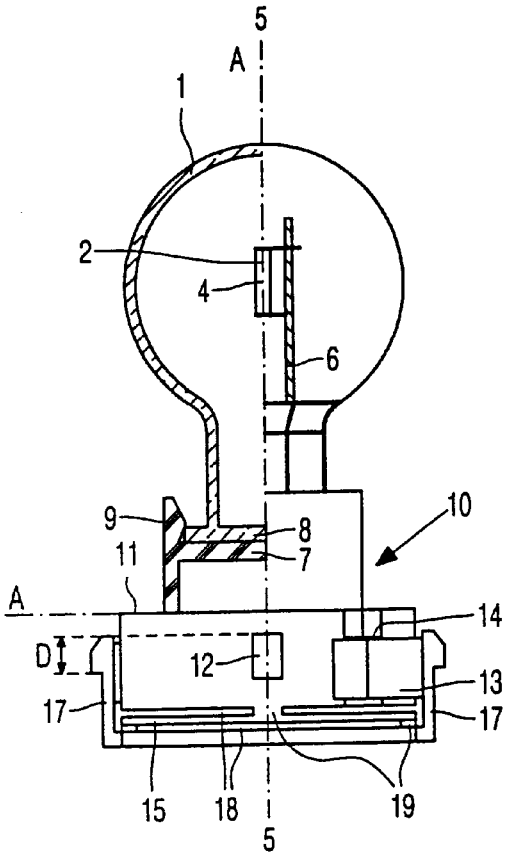
FIG. 1*a* shows a lamp with its lamp cap in side elevation, partly broken away on the line A—A.

In FIG. 1*a,* the electric lamp has a translucent lamp vessel 1, for example, made of glass, which is closed in a gastight manner and in which an electric element 2, a tungsten incandescent body with a center 4 in the Figure, is axially positioned on an axis 5 and is connected to current conductors 6 which issue from the lamp vessel to the exterior. The lamp shown has a filling of rare gas, for example an Ar/Ne mixture, with a filling pressure of somewhat above 1 bar.

A lamp cap 10 is securely connected to the lamp vessel 1. The lamp cap has a housing 11 of synthetic resin. The housing 11 comprises a flat base portion 7 which is at least substantially perpendicular to the axis 5. The lamp vessel is closed off in a gastight manner by means of a plate 8 of insulating material, which plate lies in a plane which is at least substantially perpendicular to the axis 5. The electric element 2 is mounted in a previously defined position with respect to the plate 8 during the manufacture of the lamp according to the invention. The plate of the lamp vessel is pressed home against the base portion by locking means 9, for example ridges, such that the electric element will enter a previously defined position with respect to the reference means 12, for example studs. The studs 12 form a part of the lamp cap and are designed to abut against a support 30, for example a reflector, as is visible in FIG. 2.

The lamp cap also comprises contact members 14 which are connected to respective screens 13 and to which the current conductors 6 issuing from the lamp vessel 1 are connected. A resilient intermediate portion 15 provided with coupling means 17, resilient tags in the Figure designed for coupling the reflector to the lamp cap, forms an integral whole with the housing 11. The resilient action of the intermediate portion is obtained in that the intermediate portion is made hollow, so that no more than a wall remains as the intermediate portion, whereupon a major portion of the wall, for example 95% thereof, is removed so as to form two voids 18 which run perpendicularly to the axis 5 and have a typical dimension of 1 mm. The remaining portion of the wall forms a bridge 19 which is rotated through an angle, for example of 180°, about the axis 5 for the next void.

Since the reference means are present on the housing, the coupling means are present on the resilient intermediate portion, and the housing and the coupling means are resiliently interconnected, tolerances in the axial spacing D between the reference means and the coupling means can be compensated for.

In a practical realization of the described embodiment of the lamp, the lamp has the advantage that it has a comparatively small axial dimension of approximately 5.5 cm and is nevertheless suitable for dissipating a comparatively high power of, for example, 5 to 25 W. The lamp has an operational life of approximately 6000 hours in this case.

Figure 1B:
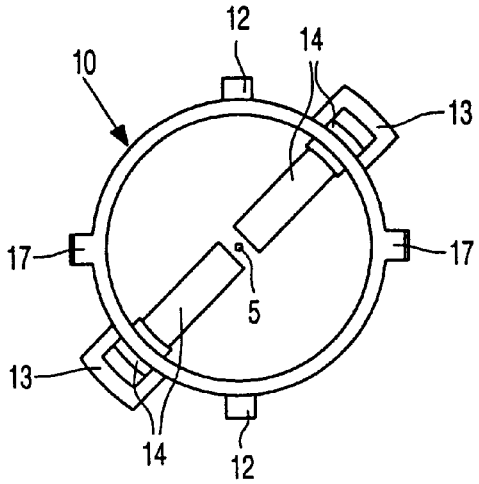
FIG. 1*b* shows a lamp cap in bottom elevation.

It is visible in FIG. 1*b* that the coupling means 17, the reference means 12, and the contact members 14 with their screens 13 occupy positions on the lamp cap 10 which are mutually rotated about the axis 5.

Figure 2:
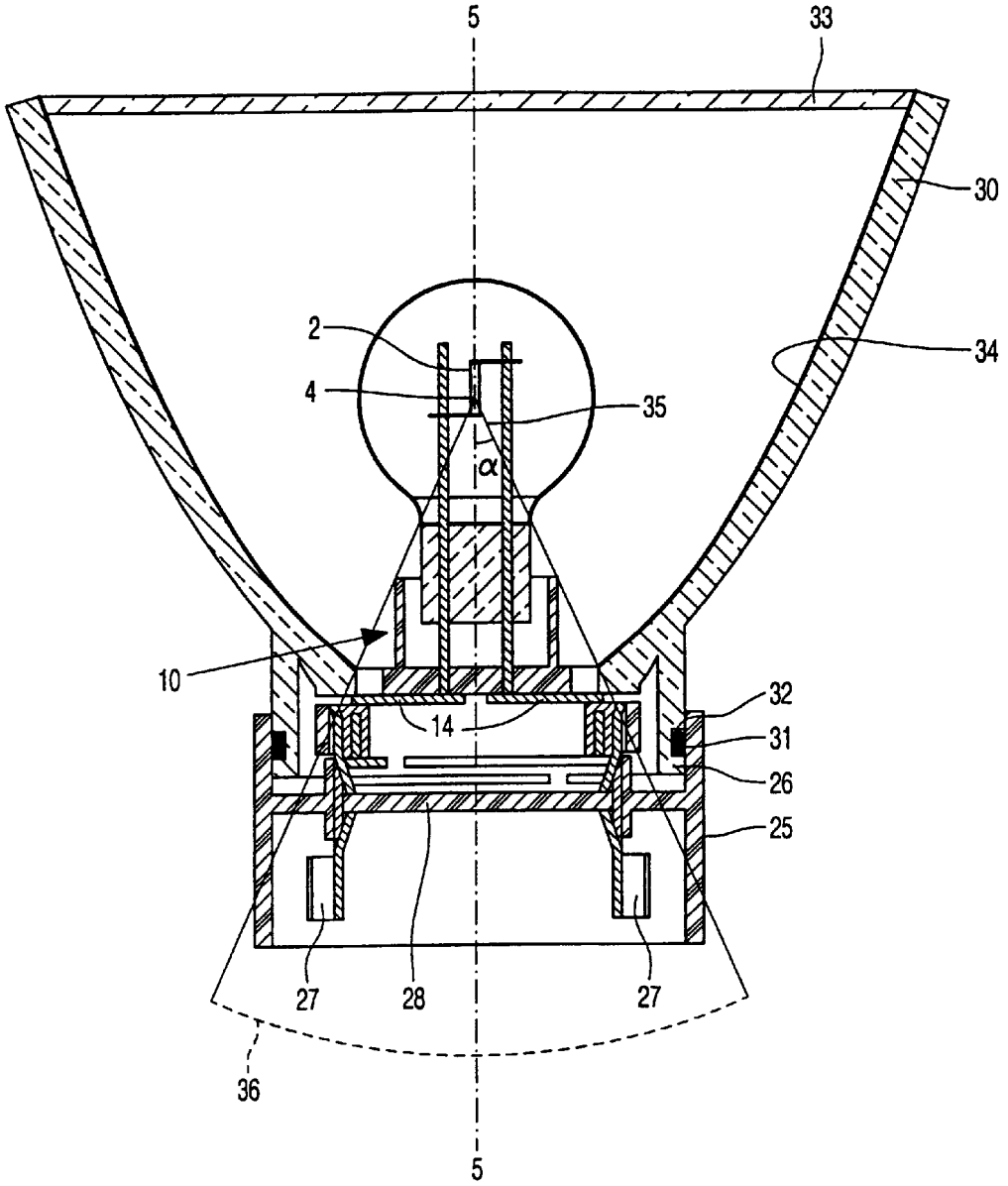
FIG. 2 shows a lamp provided with a reflector and an adapter.

FIG. 2 shows the lamp provided with a support 30, a reflector with a transparent plate 33 in the drawing, as well as with an adapter 25. In this configuration of a lamp with adapter and reflector, where the reflector is provided with a rubber ring 31 retained in a groove 32, the rubber ring seals off the opening 26 between the lamp cap and the reflector in a gastight manner. The adapter is provided with standardized contact points 27 which are passed through the bottom plate 28 of the adapter in a gastight manner and are connected to contact members 14 of the lamp cap 10.

It is visible in the drawing that the lamp cap 10 falls substantially entirely within a cone 36 which has its apex 35 in the center 4 of the electric element 2 and has an apex half angle $\alpha$ of 25°. The light originating from the electric element 2 can reach the reflecting surface 34 substantially without obstruction and is reflected there at least substantially axially in the direction of the transparent plate 33.

Figure 3:
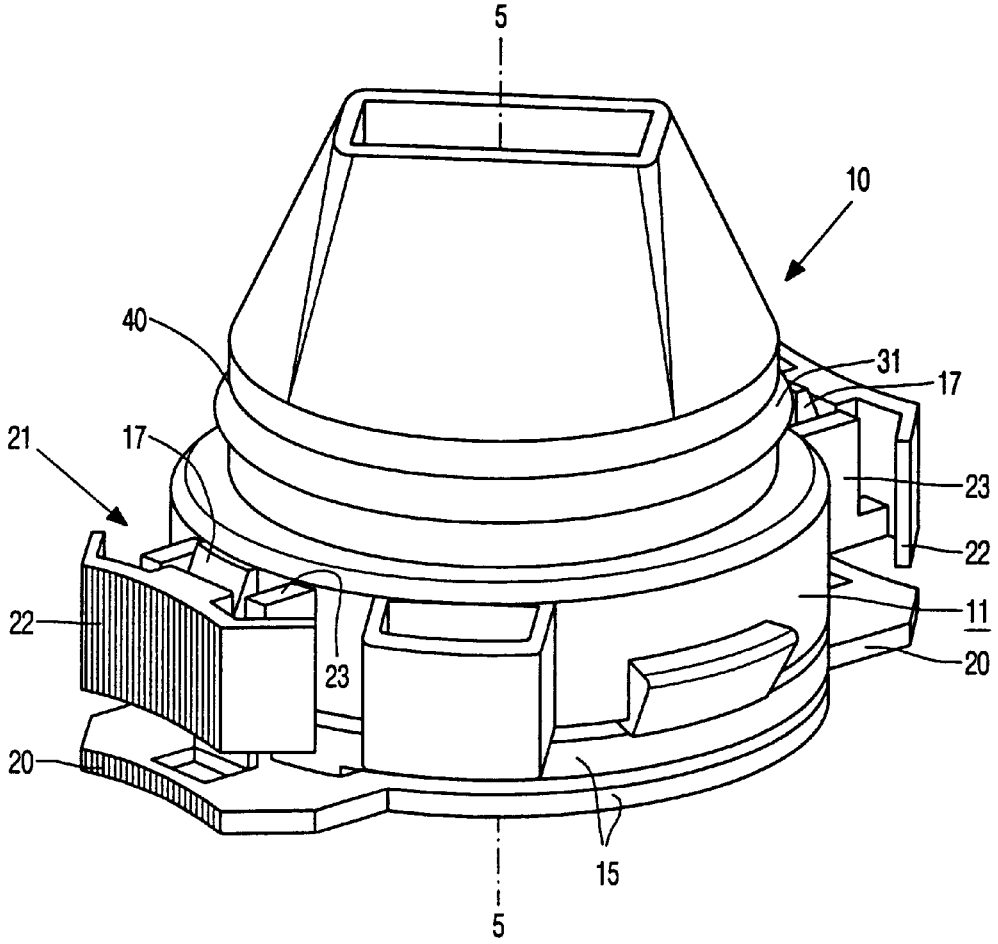
FIG. 3 is a perspective view of a lamp cap provided with uncoupling means.

FIG. 3 is a diagrammatic drawing of a lamp cap 10 in perspective view, provided with uncoupling means 21 comprising removal grips 22 and springs 23 by which said means are connected to the housing 11. The contact members 14 and their respective screens 13 have been left out in the Figure. Pressure surfaces 20, which extend transversely to the axis, are provided on the resilient intermediate portion 15 and occupy at least substantially the same rotational positions about the axis with respect to the uncoupling means 21. A coupling means 17 will be present between the housing 11 and the respective removal grip 22 of the uncoupling means 21, as seen in the radial direction. This has the advantage that the lamp can be removed from the mounted state in a simple manner. In the mounted state, the coupling means 17 are in a hooked position; when the respective removal grip 22 of the uncoupling means 21 is pressed sufficiently far towards the axis 5 for achieving a movement of the coupling means in the direction of the axis, the coupling means will leave the hooked position, and the lamp is uncoupled and can be removed. A rubber ring 31 lying in a groove 40 is provided on the lamp cap 10.

What is claimed is:

1. A capped electric lamp comprising:

a translucent lamp vessel which is closed in a gastight manner, which has an axis, and in which an electric element is arranged, said element having a center and being connected to current conductors which issue from the lamp vessel;

a lamp cap connected to the lamp vessel and comprising a housing;

wherein the housing includes;

contact members connected to the current conductors, at least one locking means for locking the lamp vessel to the lamp cap, and at least one coupling means which forms a part of the housing via an integral, resilient intermediate portion of the housing, wherein the lamp vessel is closed off in a gas-tight manner by an insulating plate situated in a plane substantially perpendicular to the axis, and the housing further comprises, a flat base portion which is substantially perpendicular to said axis and which contacts said insulating plate and includes a member for securing the lamp cap to the lamp vessel via said insulating plate.

2. A lamp as claimed in claim 1, wherein the resilient intermediate portion includes a void.

3. A lamp as claimed in claim 1, wherein the resilient intermediate portion includes at least two voids.

4. A lamp as claimed in claim 1 wherein, the contact members, and the coupling means occupy positions in a common plane transverse to the axis and which are mutually rotated about said axis.

5. A lamp as claimed in claim 1 wherein the lamp cap lies at least substantially entirely within a cone having an apex in the center of the electric element and an apex half angle of at most 25°.

6. A lamp as claimed in claim 1 wherein the contact members are provided with screening means.

7. A lamp as claimed in claim 1 wherein the housing comprises a flat base portion which is at least substantially perpendicular to the axis.

8. A lamp as claimed in claim 1 wherein the lamp cap includes at least one uncoupling means.

9. A lamp as claimed in claim 1 wherein the lamp cap includes at least one pressure surface on the resilient intermediate portion.

10. A lamp as claimed in claim 1 wherein the lamp cap includes an adapter.

11. A lamp as claimed in claim 1 wherein the lamp cap includes a rubber ring which seals off an opening between the lamp cap and a separate reflector coupled to the lamp cap.

12. A lamp as claimed in claim 1 wherein at least a major portion of the lamp cap is made of a synthetic resin material.

13. A lamp as claimed in claim 1 wherein the lamp is provided with a reflector.

14. An electric lamp comprising:

a light-transmitting lamp vessel closed in a gas-tight manner and having an axis, the lamp vessel including current conductors therein which issue out of the lamp vessel, and a lamp cap connected to the lamp vessel, the lamp cap comprising a housing which comprises;

contact members connected to respective current conductors, means for locking the lamp vessel to the lamp cap, and a resilient intermediate portion provided with an integral coupling means which together form an integral whole with the housing in a manner so as to allow mutual axial movement of the coupling means and the housing, wherein the lamp vessel is closed off in a gas-tight manner by an insulating plate situated in a plane substantially perpendicular to the axis, and the housing further comprises, a flat base portion which is substantially perpendicular to said axis and which contacts said insulating plate and includes a member for securing the lamp cap to the lamp vessel via said insulating plate.

15. The electric lamp as claimed in claim 14 wherein, the contact members and the coupling means are positioned in a common plane transverse to the axis and mutually offset circumferentially about said axis.

16. The electric lamp as claimed in claim 14 wherein the coupling means comprise at least one approximately hook-shaped element extending parallel to the axis and adapted to provide resilient axial pressure between the lamp cap and a lamp support member.

17. The electric lamp as claimed in claim 16 further comprising means for securing the lamp cap housing to the lamp vessel so as to close the lamp vessel in said gas-tight manner.

18. The electric lamp as claimed in claim 14, further comprising at least two studs adapted to abut against a lamp support member, and wherein at least a part of the lamp cap is made of a synthetic resin material, the coupling means comprises at least two resilient tags.

19. The electric lamp as claimed in claim 14 wherein the lamp includes a reflector having a groove therein which retains a rubber ring, and an adapter in contact with the reflector and rubber ring so as to compress the rubber ring and close off a space between the adapter and reflector.

* * * * *